United States Patent [19]

Shackelford et al.

[11] 4,136,483

[45] Jan. 30, 1979

[54] DOLL WITH CHANGEABLE FACIAL FEATURES

[75] Inventors: Judy Shackelford, Los Angeles, Calif.; Rouben T. Terzian, Chicago, Ill.

[73] Assignee: Marvin Glass & Associates, Chicago, Ill.

[21] Appl. No.: 754,260

[22] Filed: Dec. 27, 1976

[51] Int. Cl.[2] ..... A63H 13/00

[52] U.S. Cl. ..... 46/135 R; 46/153

[58] Field of Search ..... 46/135 R, 153; 273/155

[56] References Cited

U.S. PATENT DOCUMENTS

| | | | |
|---|---|---|---|
| 1,496,406 | 6/1974 | Bertsch | 46/135 R |
| 1,615,401 | 1/1927 | Payne | 46/153 |
| 1,762,374 | 6/1930 | Yancey | 46/135 R |
| 2,584,798 | 2/1952 | Goerditz | 46/153 |
| 4,030,239 | 6/1977 | White et al. | 46/135 R |

*Primary Examiner*—F. Barry Shay

*Attorney, Agent, or Firm*—Mason, Kolehmainen, Rathburn & Wyss

[57] ABSTRACT

A figure toy, such as a doll or the like, having a torso and a head. The head has a brow and scalp portion secured to the torso by a vertical post and against rotation relative to the torso. Between the brow and scalp portion and the torso, the head includes a face section or portion mounted for rotation on a vertical axis relative to the scalp portion and torso when the doll head is considered in upright position, e.g. on the axis of said post. The face portion includes back-to-back different facial features so that on rotation the front facial features can be changed. The face portion may include a plurality of individually rotatable members. In order to conceal the facial features rotated to the rear of the head, the scalp portion is provided with simulated hair extending therefrom downwardly at the rear of the head to a position below said facial features.

2 Claims, 7 Drawing Figures

DOLL WITH CHANGEABLE FACIAL FEATURES

BACKGROUND AND SUMMARY OF THE INVENTION

This invention relates to figurines, e.g. dolls, having changeable facial features. Broadly such dolls have been previously known. For example, U.S. Pat. No. 1,762,374 discloses a doll head wherein a vertical section of the head is mounted for rotation on a horizontal axis to change facial features. Also, U.S. Pat. No. 1,138,412 shows a doll head with back-to-back facial features and having a wig pivotally mounted at the apex of the head for selectively exposing or concealing such features. However, it is not believed that any doll or other figurine thus far has been provided with the capability of changing horizontal sections or portions of facial features of a doll, particularly in the manner provided by the present invention.

The present invention provides a toy figurine, usually in the form of a doll, having a head and a torso. The head includes an upper or scalp portion, which usually is secured to the torso against rotation relative thereto. Between the scalp portion and the torso, an intermediate movable facial portion is provided in the form of a horizontal section of the head and having differing back-to-back simulated facial features. The intermediate movable facial portion is mounted for rotation on a vertical axis relative to the torso and scalp portion. The intermediate movable facial portion can comprise a plurality of independently rotatable members. The scalp portion includes simulated hair extending downwardly at the back or rear of the head substantially the length of the head to conceal facial features rotated to the rear of the head. Thus, by rotating the facial portion, or members thereof, selected facial features may be exposed to view while others are concealed beneath the hair at the back of the head.

While this invention is susceptible of embodiment in many different forms, there is shown in the drawings and will herein be described in detail a specific embodiment and modification thereof with the understanding that the present disclosure is to be considered as an exemplification of the principles of the invention and is not intended to limit the invention to the embodiment or modification illustrated.

DETAILED DESCRIPTION OF THE PREFERRED EMBODIMENT

Figure 1:
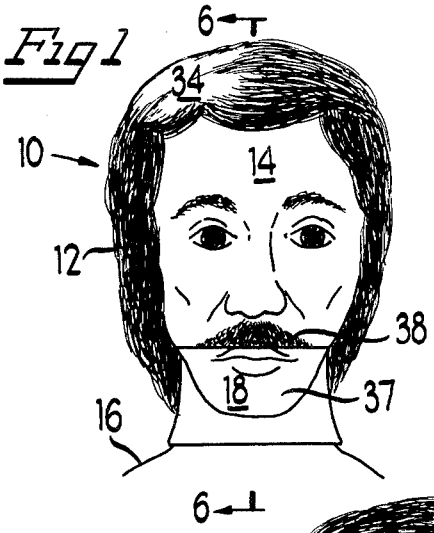
FIG. 1 is a front elevational view of a head and torso portion of an embodiment of a doll of this invention with a rotatable facial portion and positioned so as to expose a first facial feature.
Figure 2:
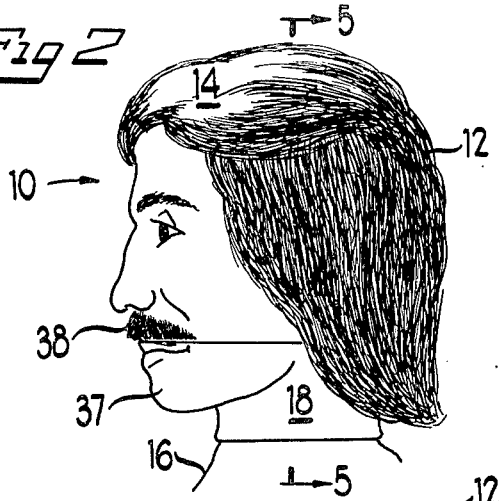
FIG. 2 is a side elevational view of the doll as shown in FIG. 1.

The preferred embodiment of this invention is a figure toy in the form of a doll, mannequin, or similar figure, indicated generally as 10 (FIGS. 1 and 2). The doll has a head 12 including a hollow scalp or upper head portion 14 and a base or torso 16 (see FIGS. 3–7). The head 12 has an intermediate horizontal section or face portion 18 (FIGS. 1 through 6) which is mounted for rotation on a vertical axis relative to the scalp portion 14 and the torso 16. Intermediate face portion 18 has back-to-back differing facial features.

An upstanding shank or post 20 is secured at its upper end to an inverted frusto-conical insert 22 (FIGS. 5 and 6) in scalp 14. The insert 22 has a flat bottom wall 24 and conical sides sloping inwardly in a downwardly direction. The lower end of post 20 is secured to a cross-frame 26 in torso 16 so that the scalp portion 14 is secured against rotation relative to the torso 16. The post 20, in securing the torso 16 to the scalp portion 14, also secures the face portion 18 between and in frictional rotational bearing against torso 16 and scalp portion 14. In the embodiment shown, the axis of rotation of face portion 18 is the axis of post 20.

Figure 7:
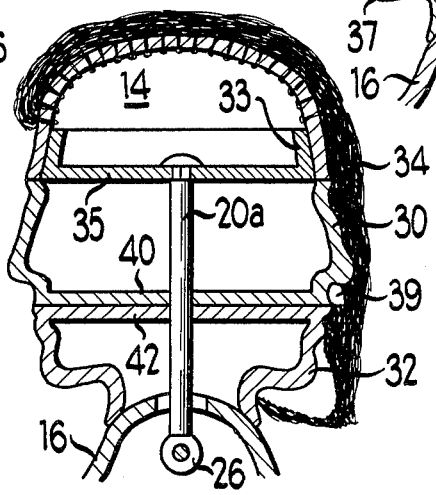
FIG. 7 is a section as in FIG. 6 showing a modification of the doll in which the facial portion is composed of two independently rotatable members.

In a second embodiment as seen in FIG. 7, a post **20*a* is provided and again is secured to and upstanding from a cross-member 26 in torso 16. The top of post 20*a* is secured to a base plate 35 of an upwardly inwardly converging frusto-conical section 33. Mounted for rotation and secured in frictional engagement with each other between scalp portion 14 and torso 16 is a facial portion comprised of two rotatable members 30 and 32 each of which has back-to-back differing facial features. Members 30 and 32 are also in frictional engagement with scalp portion 14 and torso 16 respectively. Members 30 and 32** can be rotated independently to present any one of four different facial combinations for frontal viewing.

Either embodiment has embedded within scalp portion 14 and extending therefrom tufts or other simulations of hair 34 extending downwardly at the rear of the head to at least about the lower level of the facial features on the rotatable face portion.

Figure 3:
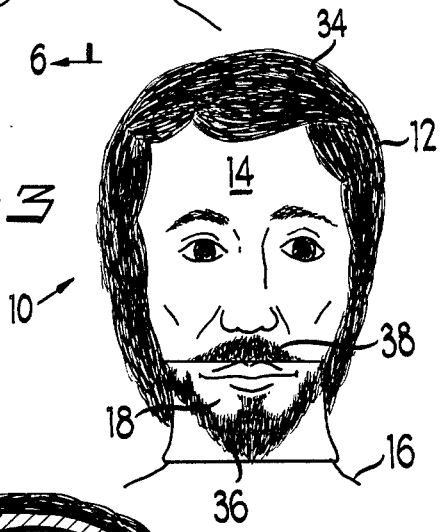
FIG. 3 is a front elevational view of the doll as shown in FIG. 1 with a different facial feature rotated into frontal position.
Figure 4:
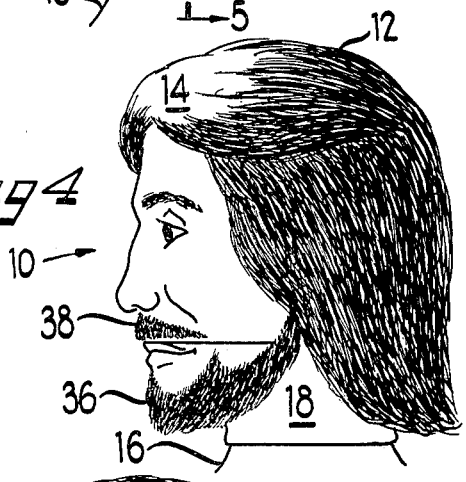
FIG. 4 is a side elevational view of the doll as shown in FIG. 3.
Figure 5:
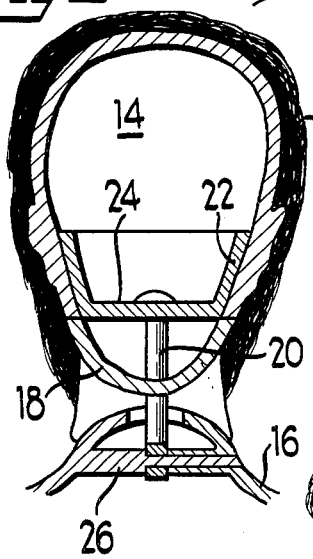
FIG. 5 is a vertical section taken generally along the line 5—5 of FIG. 2.
Figure 6:
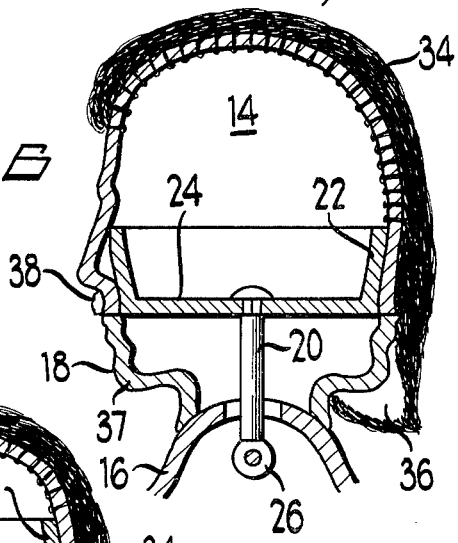
FIG. 6 is a section taken generally along the line 6—6 of FIG. 1.

As to the back-to-back impressions in the rotatable facial portion 18 in FIGS. 1 through 6, one of the impressions is a beard 36 as seen in FIGS. 3 and 4 and the other impression is a chin 37 with a clean-shaven facial feature as seen in FIGS. 1 and 2. As seen in FIG. 6, the beard 36 of the doll when rotated to the rear of the head is hidden by the downwardly extending hair 34.

In the embodiment of FIGS. 1 through 6, a mustache portion 38 on the head portion 14 faces frontwardly regardless of rotation of the intermediate portion 18. In FIG. 7 where the doll is constructed to have two independently rotatable members 30 and 32, a mustache 39 can also be rotated rearwardly and hidden beneath hair 34 for more varied changes in facial appearance of the doll. In FIG. 7, the member 30 includes back-to-back nose and eye impressions so that nose and eye appearances can be alternated as well as the chin area. Further, in FIG. 7, flat horizontal walls 40 and 42 of members 30 and 32 are facially slidable against each other during rotation and are impaled by the post **20*a* so that they are pivotal on post 20*a***, thereby better stabilizing these members in the head of the doll.

The foregoing detailed description has been given for clearness of understanding only and no unnecessary limitations should be understood therefrom as some modifications will be obvious to those skilled in the art.

We claim:

1. A figurine having changeable facial features, comprising: means defining a base of the figurine, and means defining a head of the figurine having an upper head portion including at least a part of the top of a face and simulated hair extending downwardly at the rear thereof, a lower head portion including changeable facial features oriented back-to-back and means for mounting said lower head portion for rotation about a generally vertical axis, whereby, when said lower head portion is rotated on its vertical axis relative to said base, the frontal facial features of said figurine are changed and the opposing facial features are hidden behind the simulated hair at the rear of the head, wherein said lower head portion includes a depending neck, and said means for mounting includes said neck having means defining a socket on the lower end thereof, and a complementary ball formed on the base for engagement with said socket to provide forward and rearward pivotal movement of the head relative to the base.

2. A figure toy having changeable facial features, comprising:

means defining a torso of the figure toy;

an upper head portion including at least a part of the top of a face;

simulated hair secured to the top of said upper head portion and extending downwardly on the side generally opposite the face;

an intermediate head portion including different facial features on opposite sides thereof;

a lower head portion including different facial features on opposite sides thereof;

means mounting said intermediate and lower head portions for selective rotation about a generally vertical axis relative to one another, said upper head portion and said torso, whereby the frontal facial features of the figure toy can be selectively changed and the opposing facial features are hidden behind simulated hair at the rear of the head, wherein said means mounting said movable head portions comprises a generally elongated vertical post secured at one end to the upper head portion and secured at the other end to a cross member within said torso so that the rotatable members are slidably movable against one another so that each can be selectively rotated independently to selectively change the facial features, and wherein said lower head portion includes a depending neck on said lower head portion, said neck including means defining a socket and a ball formed on the upper end of said torso for engaging said socket to provide pivotal movement of said head relative to the torso.

* * * * *